US007694849B1

(12) United States Patent
Wiesner

(10) Patent No.: US 7,694,849 B1
(45) Date of Patent: Apr. 13, 2010

(54) PRODUCT DISPENSER WITH CRANKABLE ASSEMBLY

(75) Inventor: Douglas A. Wiesner, Cincinnati, OH (US)

(73) Assignee: Turnout Products, Inc., Cincinnati, OH (US)

( * ) Notice: Subject to any disclaimer, the term of this patent is extended or adjusted under 35 U.S.C. 154(b) by 650 days.

(21) Appl. No.: 11/608,874

(22) Filed: Dec. 11, 2006

(51) Int. Cl.
*G01F 11/00* (2006.01)
*B65D 35/28* (2006.01)

(52) U.S. Cl. ..... 222/1; 222/95; 222/105; 222/326

(58) Field of Classification Search ..... 222/95, 222/101, 102, 103, 390, 92, 96, 97, 98, 99, 222/100, 106, 107, 326; 401/169
See application file for complete search history.

(56) References Cited

U.S. PATENT DOCUMENTS

| | | | | |
|---|---|---|---|---|
| 1,568,921 | A * | 1/1926 | Roberts et al. | 222/93 |
| 1,930,037 | A * | 10/1933 | Brubaker | 141/164 |
| 2,064,357 | A | 12/1936 | Ritterbusch | |
| 2,140,007 | A | 12/1938 | Grandman | |
| 2,545,751 | A * | 3/1951 | Ruch | 222/103 |
| 3,232,488 | A | 2/1966 | Headberg | |
| 3,860,147 | A | 1/1975 | Vessio et al. | |
| 3,954,205 | A | 5/1976 | Williams | |
| 4,010,873 | A | 3/1977 | Mardirossian | |
| 4,019,655 | A | 4/1977 | Moeller | |
| 4,046,288 | A | 9/1977 | Bergman | |
| 4,125,206 | A | 11/1978 | Wilson | |
| 4,160,513 | A | 7/1979 | Cockerham | |
| 4,223,809 | A | 9/1980 | Martin | |
| 4,234,104 | A | 11/1980 | Apuzzo, Jr. et al. | |
| 4,258,864 | A | 3/1981 | Karamanolis et al. | |
| 4,301,945 | A | 11/1981 | Dworkin | |
| 4,303,110 | A | 12/1981 | Chen | |
| 4,331,265 | A | 5/1982 | Warlick | |
| 4,403,714 | A | 9/1983 | Kane | |
| 4,424,916 | A | 1/1984 | Pearson | |
| 4,437,584 | A | 3/1984 | Connors et al. | |
| 4,450,982 | A | 5/1984 | Ferreira | |
| 4,508,239 | A | 4/1985 | Rozzen | |
| 4,508,242 | A | 4/1985 | Wolfe | |
| 4,570,829 | A | 2/1986 | Allen | |
| 4,585,147 | A | 4/1986 | Wodnicki | |
| 4,600,126 | A | 7/1986 | Arango | |
| 4,629,095 | A | 12/1986 | Smith | |

(Continued)

*Primary Examiner*—Kevin P Shaver
*Assistant Examiner*—Daniel R Shearer
(74) *Attorney, Agent, or Firm*—Wood, Herron & Evans, LLP

(57) ABSTRACT

A product dispenser for compelling a flowable product from a container comprising a frame assembly having first and second opposed frame assembly ends, first and second opposed dispensing notches respectively on the first and second frame assembly ends, at least one elongate drive member substantially extending between the first and second assembly ends and having first and second drive member ends. The dispenser may also have first and second drive trains each comprising a plurality of interconnected gears and each respectively operatively coupled to the first and second drive member ends, a driven member threadably coupled to the elongate drive member and adapted to travel between the first and second frame assembly ends, and a crank assembly adapted to be selectively operatively coupled to one of the drive trains. Actuation of the crank assembly may cause travel of the driven member between the first and second frame assembly ends.

10 Claims, 5 Drawing Sheets

U.S. PATENT DOCUMENTS

| | | | |
|---|---|---|---|
| 4,688,700 | A | 8/1987 | Guthrie |
| 4,793,526 | A | 12/1988 | Webb |
| 5,048,725 | A | 9/1991 | Peterson |
| 5,050,773 | A | 9/1991 | Choi |
| 5,167,348 | A | 12/1992 | Okami et al. |
| 5,203,473 | A | 4/1993 | Willey |
| 5,230,444 | A | 7/1993 | Dunbar |
| 5,271,529 | A | 12/1993 | Stuber |
| 5,305,922 | A | 4/1994 | Varon |
| 5,322,194 | A | 6/1994 | Roberts |
| 5,323,931 | A | 6/1994 | Robards, Jr. et al. |
| 5,323,932 | A | 6/1994 | Bauman |
| 5,393,153 | A | 2/1995 | Bouthillier et al. |
| 5,397,030 | A | 3/1995 | Williams |
| 5,447,255 | A | 9/1995 | Smedley |
| 5,577,640 | A | 11/1996 | Albini et al. |
| 5,810,205 | A | 9/1998 | Kohen |
| 5,813,572 | A | 9/1998 | Kolacek |
| 5,845,813 | A | 12/1998 | Werner |
| 5,868,282 | A | 2/1999 | Imhoff |
| 5,875,929 | A | 3/1999 | Nguyen |
| 5,884,812 | A | 3/1999 | Stawowski |
| 5,887,754 | A | 3/1999 | Wilkinson |
| 5,888,010 | A | 3/1999 | Laux |
| 5,897,029 | A | 4/1999 | Tong |
| 5,897,030 | A | 4/1999 | Stangle |
| 5,920,967 | A | 7/1999 | Souza |
| 5,957,334 | A | 9/1999 | Rosario |
| 5,975,362 | A | 11/1999 | West |
| 6,318,596 | B1 | 11/2001 | Wiesner |

* cited by examiner

PRODUCT DISPENSER WITH CRANKABLE ASSEMBLY

FIELD OF THE INVENTION

The invention relates to product dispensers. More specifically, the invention relates to an improved product dispenser for compelling a product from a dispenser.

BACKGROUND OF THE INVENTION

Product dispensers for compelling a flowable product from a deformable container are known in the art. Some of them are described in U.S. Pat. No. 4,125,206 issued to Wilson on a toothpaste dispenser; U.S. Pat. No. 4,508,242 issued to Wolfe on a toothpaste extractor and U.S. Pat. No. 6,318,596 issued to Wiesner on a product dispenser.

Certain prior art product dispensers may include a screw or worm gear retained within a frame having a squeezing member received upon the screw to travel from a first end of the screw to a second end of the screw to compel a flowable product from a container. Once the squeezing member has reached the end of its travel at the second end of the screw, a user must actuate the squeezing member and, therefore, the screw in a reverse direction so that the squeezing member travels along the screw back towards the first end.

Some of these prior art product dispensers require the squeezing member to travel along the length of the screw first to dispense product from a container and then reverse its direction along the screw without any work performed other than to return the squeezing member back to its origin. This requires unproductive time on the part of the user to reconfigure the dispenser for subsequent use. Further, this type of mechanism is inefficient and causes undue fatigue upon a user's fingers with manually actuated product dispensers and undue stress upon mechanical and electrical parts in an automatically actuated product dispenser, leading to accelerated mechanical and/or electrical failure of prior art product dispensers. In addition, these prior art product dispensers are generally complex in order to accommodate both forward and reverse travel of the squeezing member retained within the frame. These product dispensers have many moving parts and are not economical to manufacture or repair.

Other prior art products that include a squeezing member mounted on a screw may not require reversal in the direction of travel of the squeezing member to return it to its origin. These products, however, may include an actuating member in the form of a rotatable knob that controls travel of the squeezing member. A problem with this type of configuration, however, may lie in the relatively large magnitude of the force required to rotate the knob and cause travel of the squeezing member against the surface of the container holding the flowable product being dispensed. This problem is accentuated when the user of the product is a small child or a person with limited hand strength.

A product dispenser that does not require reversal of travel of a squeezing member while requiring a relatively low magnitude of force to be applied to an actuating member controlling travel of the squeezing member is therefore desirable.

SUMMARY OF THE INVENTION

In accordance with an embodiment of the invention, a product dispenser for compelling a flowable product from a container includes a frame assembly having first and second opposed frame assembly ends, first and second opposed dispensing notches respectively on the first and second frame assembly ends, and at least one elongate drive member having first and second drive member ends and substantially extending between the first and second assembly ends. The dispenser includes first and second drive trains each having a plurality of interconnected gears and each being respectively operatively coupled to the first and second drive member ends, a driven member threadably coupled to the elongate drive member and adapted to travel between the first and second frame assembly ends, and a crank assembly adapted to be selectively operatively coupled to one of the drive trains. The dispenser may be such that actuation of the crank assembly causes travel of the driven member between the first and second frame assembly ends and such that actuation of the crank assembly causes the product to be expelled from the product container when the product container is positioned in the frame assembly and in communication with one of the dispensing notches.

In another embodiment, a product dispenser for compelling a flowable product from a deformable container includes a frame assembly having first and second opposed frame assembly ends, at least one elongate drive member having first and second drive member ends and substantially extending between the first and second opposed frame assembly ends, and a driven member threadably coupled to the at least one drive member and adapted to travel between the first and second frame assembly ends. The dispenser may further include a dispensing plate having a dispensing notch and adapted to be selectively coupled to one of the frame assembly ends, and a crankable drive train assembly adapted to be selectively operatively coupled to one of the drive member ends. The dispenser may be such that actuation of the crankable drive train assembly causes travel of the driven member between the first and second frame assembly ends, and such that actuation of the crankable drive train assembly causes the product to be expelled from the product container when the product container is positioned in the frame assembly and in communication with one of the dispensing notches.

In another aspect of the invention, a method for compelling a flowable product from a deformable product container may include the steps of inserting the product container into a frame assembly having first and second opposed frame assembly ends, first and second opposed dispensing notches respectively on the first and second frame assembly ends, at least one elongate drive member having first and second drive member ends and substantially extending between the first and second frame assembly ends, and first and second drive trains respectively operatively coupled to the first and second drive member ends.

The method may include the steps of positioning the product container within the frame assembly to expel the product through the first dispensing notch, releasably operatively coupling a crank assembly to the second drive member end, actuating the crank assembly to cause travel in a first direction from the second frame assembly end to the first frame assembly end of a driven member threadably engaged to the at least one drive member, applying pressure on the container with the driven member to thereby compel the product from the container and through the first dispensing notch, and uncoupling the crank assembly from the second drive member end.

The method may further include the steps of removing the container from the frame assembly, inserting a second product container into the frame assembly to expel the product through the second dispensing notch, releasably operatively coupling the crank assembly to the first drive member end, and actuating the crank assembly to cause travel of the driven member in a second direction from the first frame assembly end to the second frame assembly end.

Advantageously, a product dispenser in accordance with the principles of the invention does not require reversal of travel of the driven member before insertion of a second product container and, in light of the crank assembly, requires a relatively low magnitude of force to be applied to drive the driven member and thereby expel product from the product container.

BRIEF DESCRIPTION OF THE DRAWINGS

These and other objectives and advantages will become readily apparent to those of ordinary skill in the art from the following description of embodiments of the invention and from the drawings in which.

DETAILED DESCRIPTION

Figure 1:
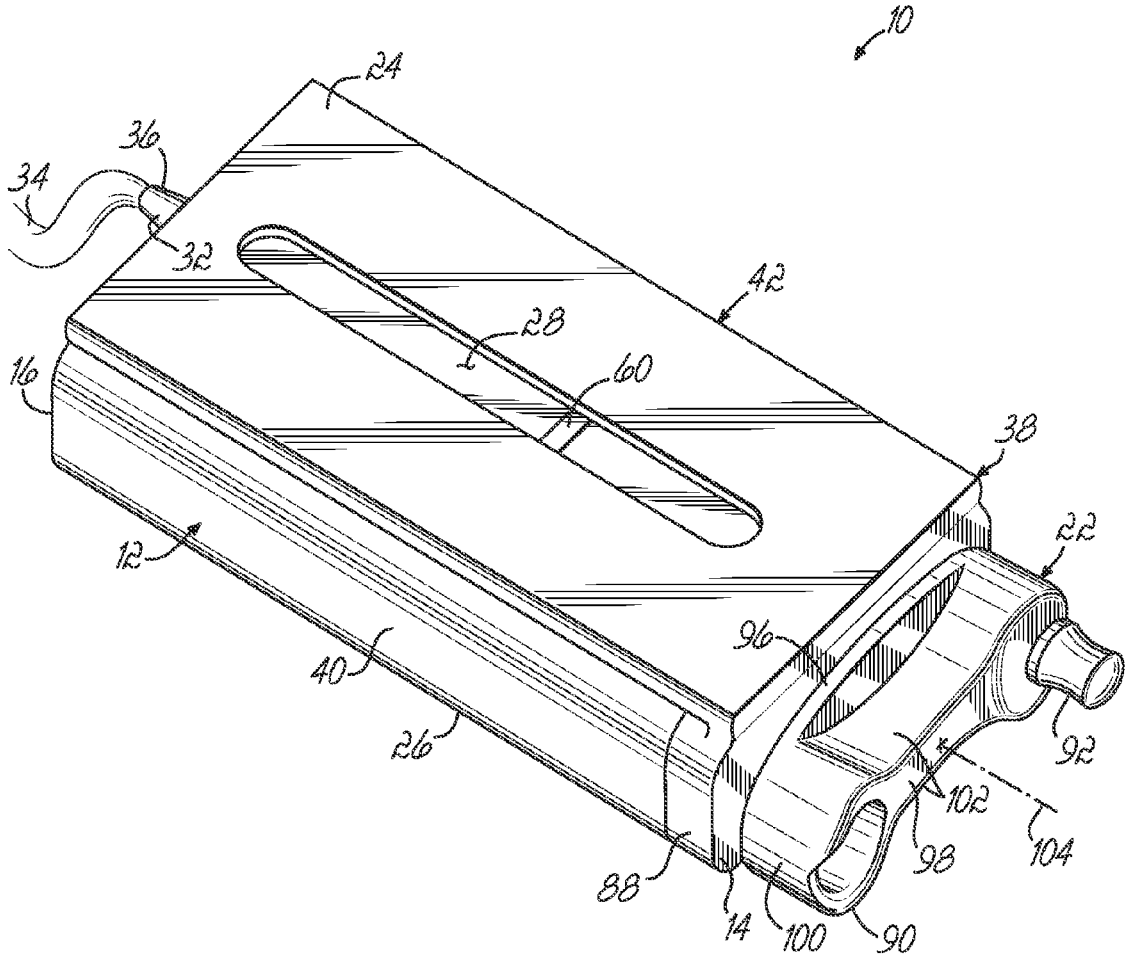
FIG. 1 is a perspective view of a product dispenser showing flow of a product from the dispenser.

With respect to the figures, and more particularly to FIG. 1, a product dispenser 10 in accordance with the principles of the invention includes a frame assembly 12 having opposed first and second ends 14, 16 in the form of walls 18, 20 (FIG. 2), a crank assembly 22 coupled to the first end 14 of the frame assembly 12, top and bottom walls 24, 26, a window 28 on the top wall 24, and an opening (not shown) through the wall 20 at the second frame assembly end 16 such that a product container 32 containing a product 34 is in fluid communication with the outside of the dispenser 10. FIG. 1 depicts an exemplary nozzle 36 of a product container 32 extending through the opening 30 such that the product 34 is expelled from the product dispenser 10 as shown. Nevertheless, a supply of the product 34 may be positioned in the dispenser 10 with or without the container 32.

Figure 2:
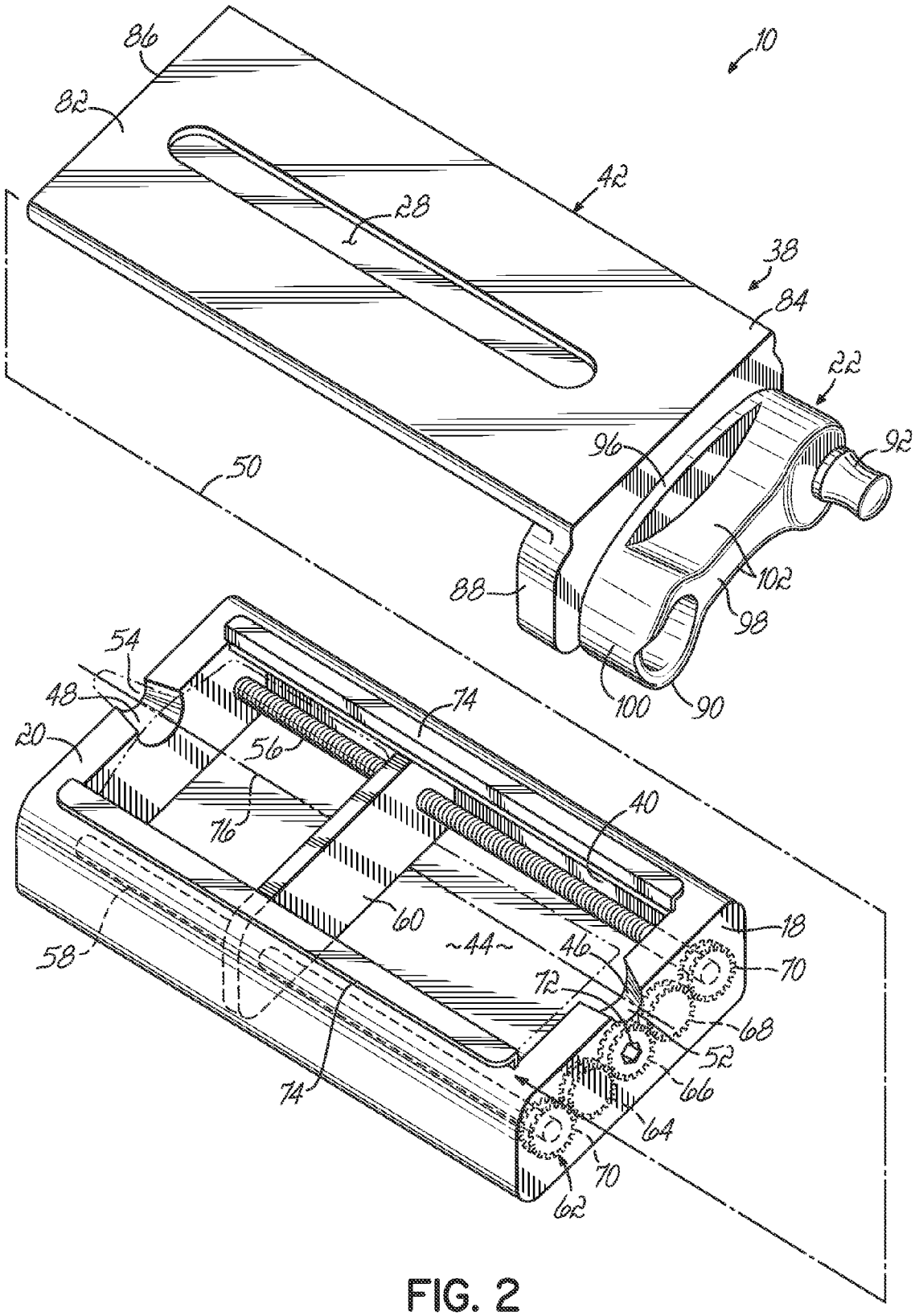
FIG. 2 is a perspective assembly view of the dispenser of FIG. 1.

With reference to FIG. 2, the product dispenser 10 includes a frame assembly 12 and a cover assembly 38 held together, for example, frictionally, magnetically or mechanically. The frame assembly 12 includes two lateral walls 40, a bottom wall 26 and an oppositely located opening 44 adapted to receive the cover assembly 38. The frame assembly 12 has two oppositely located first and second dispensing notches 46, 48 respectively on the first and second end walls 18, 20. When the frame assembly 12 and cover assembly 38 are joined together following a direction indicated by the arrow 50, the first and second notches 46, 48 respectively define first and second product dispensing openings 52, 54 (FIG. 4A) fluidly communicating the interior and exterior of the product dispenser 10. The dispensing notches 46, 48 include any suitable shape and dimensions to accommodate particular types of product containers. A notch 46, 48 may, for example, be frustoconically shaped such that it may receive a matching frustoconical shape of a nozzle 36 of a product container 32 such as nozzles commonly found in certain toothpaste tubes.

One or more elongated drive members 56, 58 extend substantially between the first and second frame assembly end walls 18, 20 and are positioned so as not to substantially obstruct the product container 32. In the exemplary embodiment of FIG. 2, two drive members 56, 58 are spaced and respectively located proximate the lateral walls 40 of the frame assembly 12. The drive members 56, 58 are externally threaded, as shown, and are made of a suitable material to permit structural rigidity. The drive members 56, 58 may, for example, be made of plastic, wood or metal. The drive members 56, 58 in this exemplary embodiment are suitably joined to one or both of the frame assembly end walls 18, 20 but may alternatively not be joined to the end walls 18, 20 at all.

With continued reference to FIG. 2, a driven member 60 in the form of a generally flat plate is threadably coupled to each of the drive members 56, 58 such that rotational motion of a drive member 56, 58 will cause travel of the driven member 60 in a direction between the first and second frame assembly ends 14, 16. The driven member 60 includes a flat prism shape, as depicted, but it may alternatively include any shape suitable to travel between the first and second frame assembly ends 14, 16 and engage a product container 32 held by the dispenser 10. The driven member 60 has suitable dimensions to allow engagement of the product container 32. In the exemplary embodiment of FIG. 2, the driven member 60 has a width substantially extending between the inner faces of the lateral walls 40 of the dispenser 10 and has a height substantially extending between the inner faces of the top and bottom walls 24, 26. The driven member 60 may be made of any suitable material such as plastic, wood or metal such that it maintains structural rigidity while engaging a product container 32 and such that it may be suitably threadably coupled with the drive members 56, 58.

Figure 3:
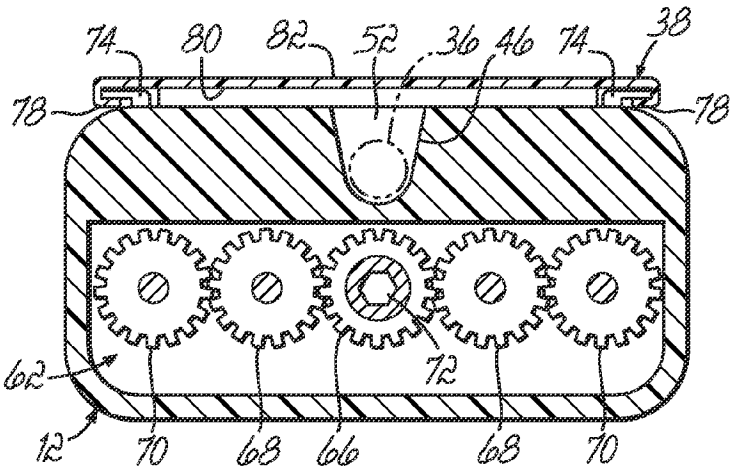
FIG. 3 is an end cross-sectional view taken along line 4-4.

With reference to FIGS. 2-3, two drive trains 62 are formed into each the frame assembly end walls 18, 20. The drive train 62 includes any suitable method and components suitable to transfer rotational motion of one member or portion of the drive train 62 to one or more drive members 56, 58. The drive train 62 may, for example, include several serially connected gears. In the exemplary embodiment of FIG. 2, a centrally located driving gear 66 is coupled to two oppositely located first driven gears, each of which is in turn coupled to one of a pair of second driven gears 70. Each of the second driven gears 70 is operatively connected to an end of a drive member 56, 58 such that rotation of a second driven gear 70 causes rotation of the drive member 56, 58 connected thereto. Functionally, in this exemplary embodiment, rotation of the driving gear 66 in one direction causes rotation of each of the drive members 56, 58 in the same direction as the rotational direction of the driving gear 66. The driving gear 66 further includes a suitably shaped aperture 72 to allow engagement by a tool or crank mechanism.

Two tracking elements 74 made, for example, of metal or any other suitable material, extend substantially between the first and second end walls 18, 20, lie on a plane defined by the opening 44 of the product dispenser 10, and are oppositely located from a longitudinal axis 76 of the product dispenser 10. The shape, dimensions and material of the tracking elements 74 may be suitably chosen to permit engagement of the tracking elements 74 with a pair of channel members 78 (FIG. 3) located on an interior face 80 of the cover assembly 38. While the embodiment of FIGS. 2 and 3 depict a pair of complementary tracking elements 74 and channel members 78 to provide mechanical interlocking of the frame assembly 12 and the cover assembly 38, persons of ordinary skill in the art will appreciate that, alternatively, other methods and components may be used to facilitate interlocking of the frame assembly 12 and cover assembly 38. These may include, for example, magnetic components to permit magnetic locking or frictional elements such as textured surfaces or tightly fitting complementary elements.

With reference to FIG. 2, a cover assembly 38 includes a generally flat, rectangular cover member 82 having first and second cover member ends 84, 86. The cover assembly 38 further includes a plate portion 88 extending perpendicularly from the first end 84 of the cover member 82, and a crank assembly 22 adjacent the plate portion 88. The cover member 82 is substantially dimensioned to cover the opening 44 in the frame assembly 12 and may be made of any suitable material to securely engage the frame assembly 12, such as plastic, wood or metal. The cover member 82 includes a window 28 to permit viewing of a product container 32 within the product dispenser 10. The window 28 includes suitable dimensions, shape and materials, such as translucent or transparent materials, to permit viewing of the product 34. While the embodiment of FIG. 2 depicts a window 28 centrally located along the axis of the product dispenser 10, the window 28 may alternatively be located anywhere on the body of the cover member 82. Similarly, while the embodiment of FIG. 2 depicts a window 28 defining an area substantially smaller than the area defined by the cover member 82, a person of ordinary skill in the art will appreciate that, alternatively, the window 28 may be substantially larger with respect to the cover member 82 or even be such that the entire cover member 82 is translucent or transparent, thereby permitting viewing anywhere through the body of the cover member 82.

Figure 4A:
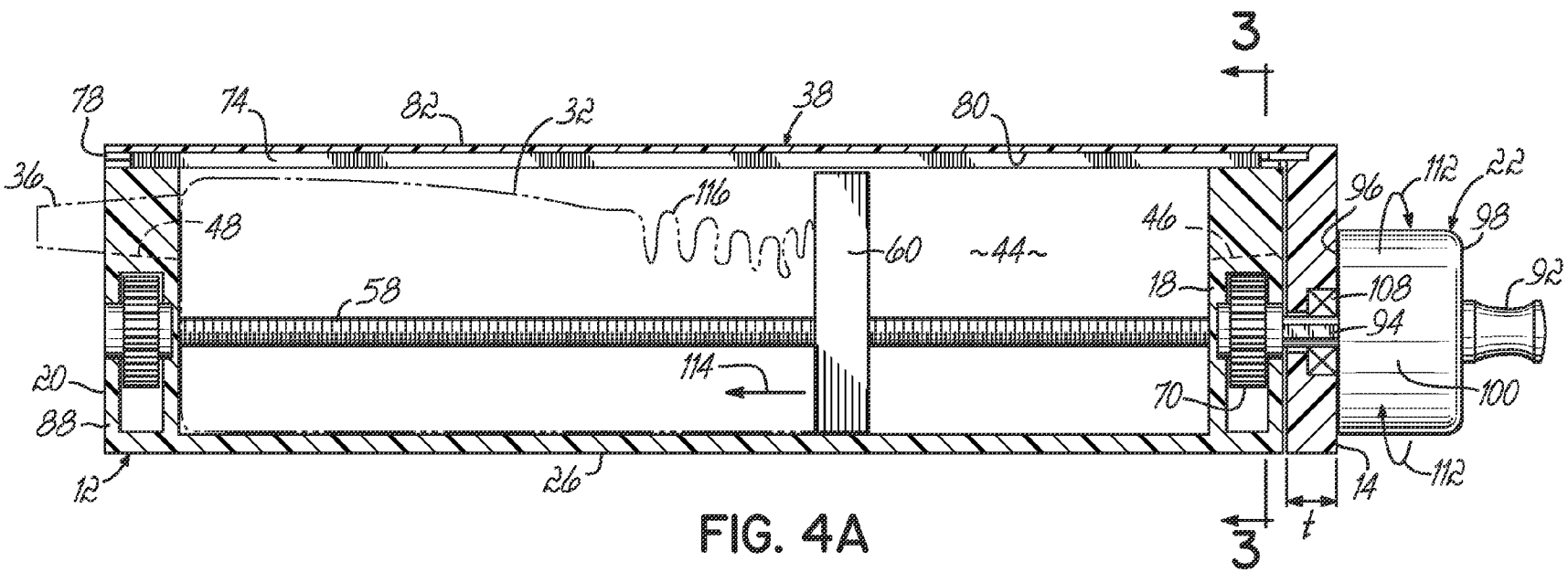
FIG. 4A is an elevational cross-sectional view of the dispenser of FIGS. 1-2.

With reference to FIGS. 2 and 4A, the crank assembly 22 is releasably or fixedly coupled to the plate portion 88 of the cover assembly 38. The crank assembly 22 includes a main body portion 90, a knob 92 and an engaging member 94. The main body portion 90 of the crank assembly 22 includes suitable material, shapes and dimensions to permit manual rotation thereof. It may, for example, be made of plastic and have a shape generally as shown (FIG. 2). In the exemplary embodiment of FIG. 2, the main body portion 90 has opposed inner and outer faces 96, 98, a generally oval-shape outer surface 100 perpendicular to the inner and outer faces 96, 98, and depressions 102 in its center portion, such as to permit convenient grip by a human hand. A knob 92 is coupled to or may be alternatively integrally formed with the main body portion 90 of the crank assembly 38, and extends outwardly from the plane of the outer face 98 of the main body portion 90, to provide an alternative gripping surface to permit rotation of the crank assembly 38. The inner face 96 of the main body portion 90 is generally adjacent the plate portion 88 of the crank assembly 38 while not affixed thereto, thereby permitting rotation of the main body portion 90 about an axis 104 (FIG. 1) generally parallel to the longitudinal axis 76 of the product dispenser 10.

Figure 4B:
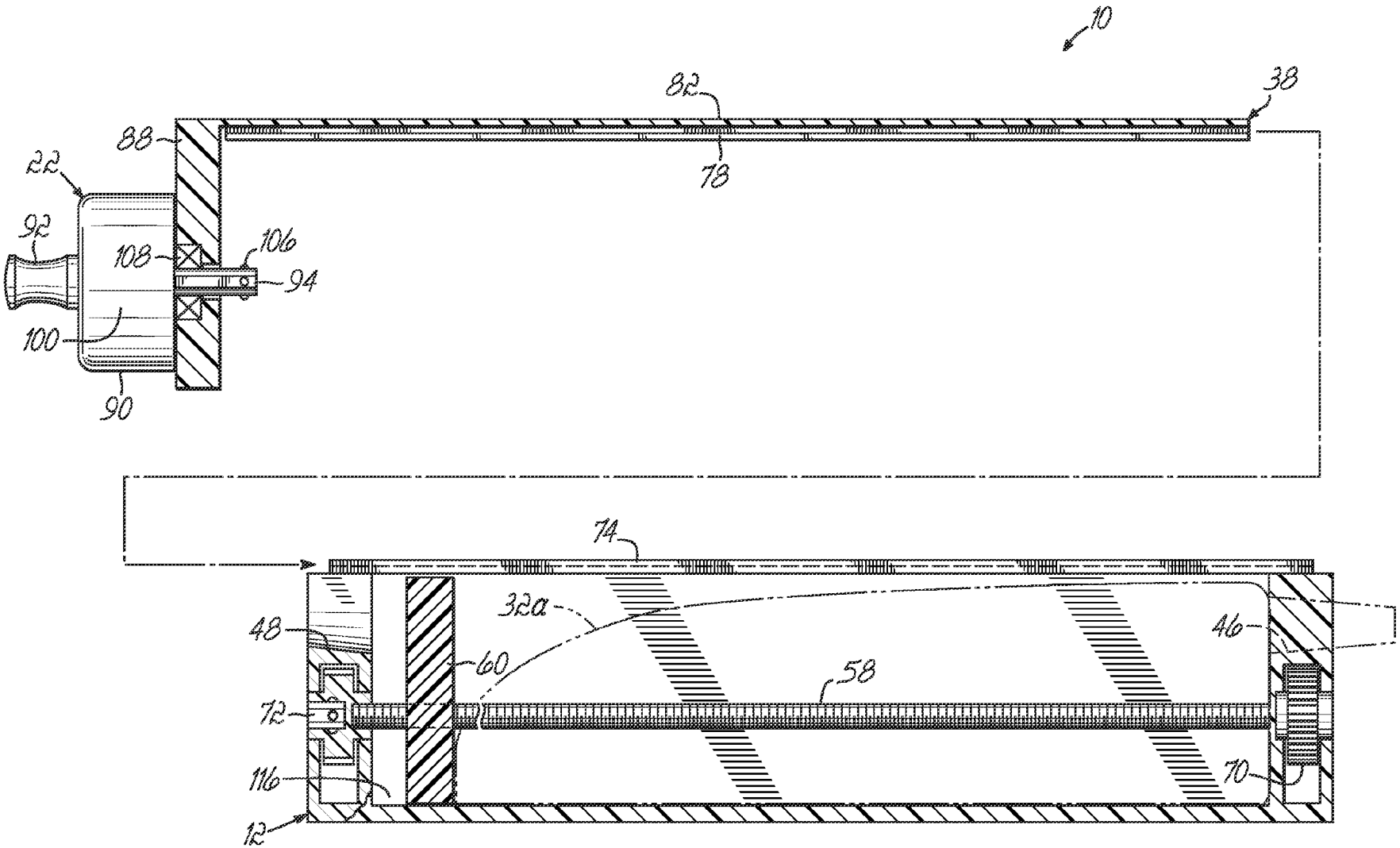
FIG. 4B is an elevational cross-sectional assembly view of the dispenser of FIGS. 1-4.

With continued reference to FIGS. 2, 4A-4B, an engaging member 94, including materials, shapes and dimensions suitable to engage the aperture 72 in the driving gears 66 of the frame assembly 12, extends from the main body portion 90 of the crank assembly 38, through the thickness "t" of the plate portion 88 and projects by a length suitable to engage the aperture 72 in the driving gears 66. The engaging member 94 further includes a set of locking elements such as detent ball bearings 106 to prevent the main body portion 90 from separating from the plate portion 88 as well as to permit mechanical engagement with the driving gear aperture 72. A bushing element 108 surrounds the engaging member 94 at least partially through the thickness of the main body portion 90. The bushing element 108 permits smooth rotation of the main body portion 90 with respect to the plate portion 88. Although a bushing element is 108 depicted, persons of ordinary skill in the art will appreciate that, alternatively, the engaging member 94 may be surrounded by any suitable components to facilitate rotation as described above or may be surrounded by no components at all.

The plate portion 88 is made of a suitable material and suitable thickness "t" to permit coupling with the frame assembly 12 and maintain the structural integrity of the product dispenser 10. The plate portion 88 is coupled to the cover member 82 by any suitable components and methods such as mechanical fasteners, magnetic elements or adhesives or may alternatively be integrally formed therewith, as depicted in FIGS. 2, 4A-4B.

With reference to FIG. 4B, the cover assembly 38 is slidably engaged with the frame assembly 12 in a direction as depicted by the arrow 110, such that the tracking elements 74 of the frame assembly 12 engage the channel members 78 of the cover assembly 38. The joining of the cover assembly 38 and the frame assembly 12 defines a cavity within which a product container 32 may be placed for dispensing of the product 34 therein.

With reference to FIGS. 4A-4B, a product container is positioned within the frame assembly 12 in an orientation as depicted in FIG. 4A, such that a portion of the container 32 from which the product 34 is to be expelled is at least partially placed within the first notch 46. In the exemplary embodiment of FIG. 4A, a nozzle 36 on the product container 32 is placed in the first notch 46. The crank assembly 22 is actuated by rotating the main body portion 90 as indicated by the arrows 112 such that the drive member 56, 58 is caused to rotate in the same direction. This rotation causes the driven member 60 to move in a direction as indicated by the arrow 114, generally in a direction from the first frame assembly end 14 toward the second frame assembly end 16. The longitudinal movement of the driven member 60 exerts pressure on the product container 32, which is thereby deformed as illustrated by the puckered section 116 of the container 32 shown behind the driven member 60.

The deformation of the product container 32 causes the product 34 to be compelled out of the product container 32 through the nozzle 36, where it may be redirected or applied as desired. When the product 34 is compelled out of the container 32, it may be applied directly onto a tool or surface (not shown).

With continued reference to FIGS. 4A-4B, when it is desired to replace the container 32 because, for example, substantially all of the product 34 has been used, the cover assembly 38 is first uncoupled from the frame assembly 12 to expose and provide access to the container 32. The driven member 60 will be generally proximate the second frame assembly end wall 20. The container 32 is then removed from the product dispenser 10 and a second container 32*a* is placed within the frame assembly 12 such that the nozzle 36 or functionally equivalent portion of the container 32 is at least partially placed on the second notch 48. The cover assembly 38 is advantageously turned around with respect to its original orientation, described above, and coupled to the frame assembly 12 such that the plate portion 88 is now adjacent the second frame assembly end wall 20. Actuation of the crank assembly 22 via rotation of the main body portion 90 will thereby result in longitudinal motion of the driven member 60 in a direction from the second frame assembly end 16 toward the first frame assembly end 14.

By permitting coupling of the cover assembly 38 with either frame assembly end wall 18, 20, the exemplary embodiment of FIGS. 1-4B does not require reversal of travel of the driven member 60 before insertion of the second product container 32*a*. Further, because of the chosen shape and size of the main body portion 90 of the crank assembly 22, the product dispenser 10 requires a relatively low magnitude of force to cause product 34 to be expelled from the product container 32, 32*a*.

Figure 5:
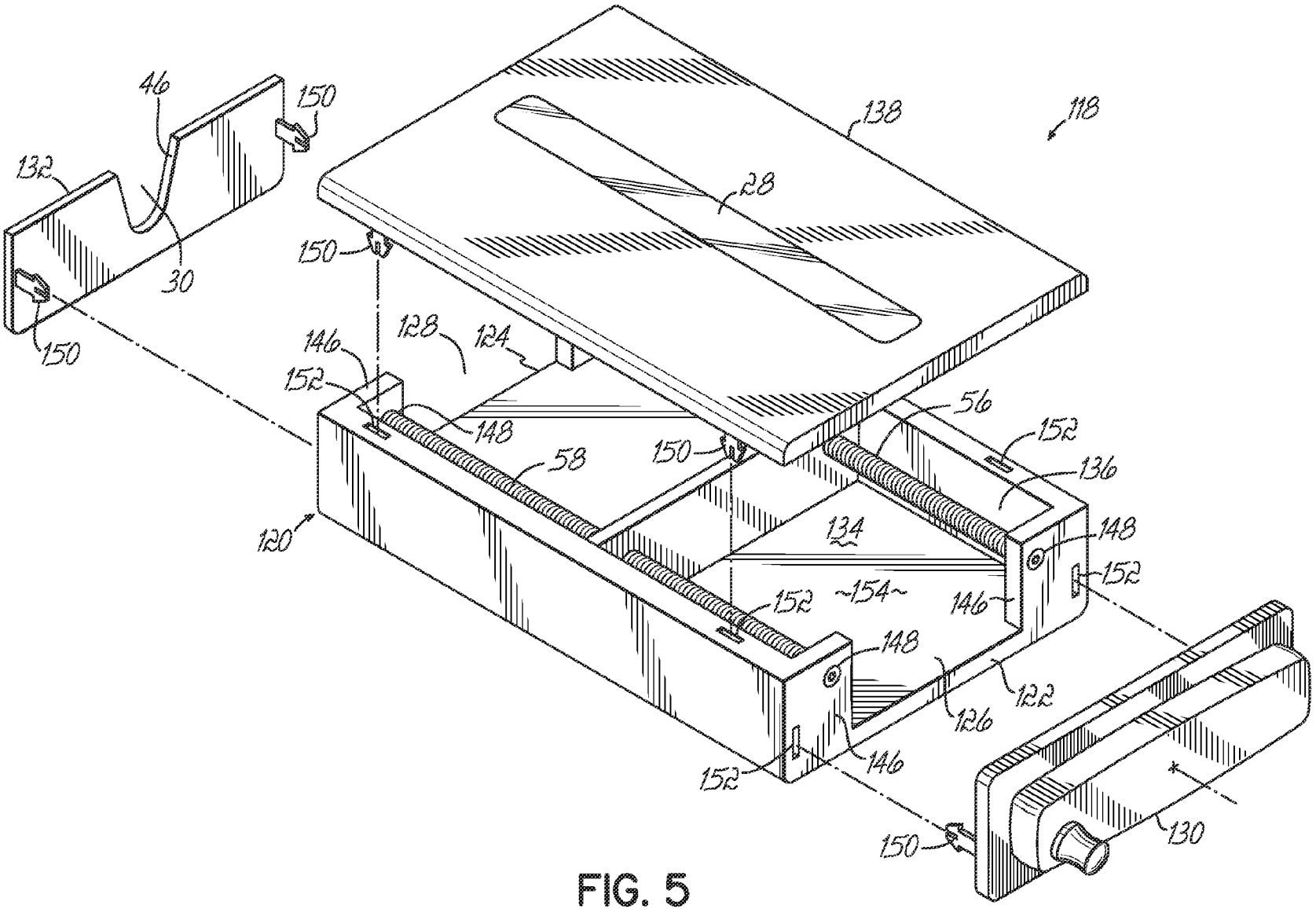
FIG. 5 is a perspective assembly view of an alternative embodiment of a product dispenser.

With reference to FIG. 5, in which like reference numerals refer to like features in FIGS. 1-4B, an alternative embodiment of a product dispenser 118 includes a generally U-shaped frame assembly 120 having opposed first and second ends 122, 124 in the form of openings 126, 128, a crankable drive train assembly 130 coupled to the first end 122 of the frame assembly 120, a dispensing plate 132 coupled to the second frame assembly end 124, a bottom wall 134, and a top opening 136 adapted to receive a cover 138 that includes a window 28.

The dispensing plate 132 includes a dispensing notch 46, similar to the dispensing notch of FIG. 2, a description of which may be referred to for an understanding of the notch 46 of FIG. 5 as well. When the frame assembly 120 and cover 138 are joined together following a direction indicated by the arrows 140, the notch 46 defines a product-dispensing opening 30 fluidly communicating the interior and exterior of the product dispenser 118. The crankable drive train assembly 130, which is adapted to be selectively coupled to the first and second frame assembly ends 122, 124, includes a drive train wall 142 and a crank assembly portion 144. The drive train wall 142 contains a drive train (not shown but similar to drive train 62 of FIG. 2) and is similar to each of the walls 18, 20 defining the frame assembly ends 14, 16 of the frame assembly 12 of FIG. 2. The drive train of the embodiment in FIG. 5 is similar to the drive train of FIG. 3, the description and operation of which may be referred to for an understanding of the drive train of FIG. 5 as well. The crank assembly portion 144 is similar to the crank assembly 22 of FIGS. 1-4B, the description and operation of which may be referred to for an understanding of the crank assembly portion 144 of FIG. 5 as well.

With continued reference to FIG. 5, the frame assembly 120 includes one or more elongated drive members 56, 58 and a driven member 60 respectively similar to the drive members 56, 58 and driven member 60 of FIG. 2, the respective descriptions of which may be referred to for an understanding of the drive members 56, 58 and driven member 60 of FIG. 5 as well. One or more support blocks 146 support the ends 148 of the drive members 56, 58. The blocks 146 have a construction and shape suitable to maintain the drive members 56, 58 at respective fixed positions with respect to the rest of the frame assembly 120 when the cover 138, dispensing plate 132 and crankable drive train assembly 130 are uncoupled from the frame assembly 120. Alternatively, other suitable components may replace the support blocks 146 so long as they maintain the drive members 56, 58 at respective fixed positions with respect to the frame assembly 120. The cover 138 is similar to the cover member 82 of FIG. 2, the description of which may be referred to for an understanding of the cover 138 of FIG. 5 as well.

When the frame assembly 120, dispensing plate 132, crankable drive train assembly 130 and cover 138 are releasably coupled together, for example, via locking elements 150 and matching apertures 152, a cavity 154 is defined that is suitable to hold a product container 32 such as a toothpaste tube. The operation of the product dispenser 118 is similar to the operation of the product dispenser 10 of FIGS. 1-4B, the description of which may be referred to for an understanding of the operation of the product dispenser 118 of FIG. 5 as well. A difference between the respective operations of the product dispensers 10, 118 lies in that the product dispenser 118 of FIG. 5 requires positional swapping of the dispensing plate 132 and crankable drive train assembly 130 with respect to the first and second ends 122, 124 of the frame assembly 120 in order to get the dispenser 118 ready to receive a second product container 32*a*.

Accordingly, many further embodiments, applications and modifications of the invention will become readily apparent to those of ordinary skill in the art without departing from the scope of the invention that is intended to be bound only by the claims appended hereto.

What is claimed is:

1. A method for compelling a flowable product from a deformable product container, comprising the steps of:

inserting the product container into a frame assembly having first and second opposed frame assembly ends, first and second opposed dispensing notches respectively on the first and second frame assembly ends, at least one elongate drive member substantially extending between the first and second frame assembly ends and having first and second drive member ends, and first and second drive trains respectively operatively coupled to the first and second drive member ends;

positioning the product container within the frame assembly to expel the product through the first dispensing notch;

releasably operatively coupling a crank assembly to the second drive member end;

actuating the crank assembly to cause travel in a first direction from the second frame assembly end to the first frame assembly end of a driven member threadably engaged to the at least one drive member;

applying pressure on the container with the driven member to thereby compel the product from the container and through the first dispensing notch;

uncoupling the crank assembly from the second drive member end;

removing the container from the frame assembly;

inserting a second product container into the frame assembly to expel the product through the second dispensing notch;

releasably operatively coupling the crank assembly to the first drive member end; and actuating the crank assembly to cause travel of the driven member in a second direction from the first frame assembly end to the second frame assembly end.

2. The method of claim 1, wherein actuating the crank assembly comprises manual actuation of the crank assembly.

3. A product dispenser for dispensing a flowable product comprising:

a frame assembly having first and second opposed frame assembly ends;

first and second opposed dispensing notches respectively on said first and second frame assembly ends;

at least one elongate drive member substantially extending between said first and second frame assembly ends and having first and second drive member ends;

first and second drive trains each comprising a plurality of interconnected gears and each respectively operatively coupled to said first and second drive member ends;

a driven member threadably coupled to said at least one elongate drive member and adapted to travel between said first and second frame assembly ends; and a crank assembly adapted to be selectively operatively coupled to one of said drive trains;

wherein:

actuation of said crank assembly causes travel of said driven member between said first and second frame assembly ends; and actuation of said crank assembly causes the product to be expelled from the product dispenser when the product is positioned in said frame assembly and in communication with one of said dispensing notches.

4. The dispenser of claim 3 wherein actuation of said crank assembly further comprises moving said driven member in a direction away from said crank assembly.

5. The dispenser of claim 3, further comprising opposed top and bottom walls defining a cavity in which the product is positioned, at least one of said top and bottom walls defining a window through which the product in said cavity is viewable.

6. The dispenser of claim 3 wherein said plurality of gears are serially connected.

7. The dispenser of claim 5 wherein one of said top and bottom walls is coupled to said crank assembly.

8. The dispenser of claim 5 wherein one of said top and bottom walls is integrally formed with said crank assembly.

9. The dispenser of claim 8 wherein said frame assembly is symmetric about a transverse plane.

10. The dispenser of claim 9 wherein said frame assembly is symmetric about a longitudinal plane.

* * * * *